US006368458B1

(12) United States Patent
Graf et al.

(10) Patent No.: US 6,368,458 B1
(45) Date of Patent: Apr. 9, 2002

(54) CALENDER PRESS FOR A PAPER-MAKING MACHINE WITH THERMALLY COMPENSATED TOP AND BOTTOM ROLLS AND LOW NIP LOAD

(75) Inventors: Edwin X. Graf, Menasha; James A. Eng, Appleton, both of WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/534,933

(22) Filed: Mar. 24, 2000

Related U.S. Application Data

(63) Continuation of application No. 09/044,420, filed on Mar. 19, 1998.

(51) Int. Cl.[7] ..... B30B 3/04; B02C 11/08

(52) U.S. Cl. ..... 162/206; 162/198; 162/262; 162/263; 162/361; 162/375; 100/163 A; 100/329; 100/332; 492/46

(58) Field of Search ..... 162/262, 263, 162/358.5, 358.1, 357, 206, 198, 207, 361, 375; 100/163 A, 329, 332; 492/46

(56) References Cited

U.S. PATENT DOCUMENTS 3,190,212 A * 6/1965 Moore ..... 100/332
3,379,857 A * 4/1968 Rosenstein ..... 100/332
4,114,528 A * 9/1978 Walker ..... 100/332
4,573,402 A * 3/1986 Sharma et al. ..... 100/332
4,671,173 A * 6/1987 Boissevain ..... 100/332
4,675,487 A * 6/1987 Verkasalo ..... 100/332
4,685,389 A * 8/1987 Boissevain ..... 100/332
4,738,196 A * 4/1988 Boissevain ..... 100/332
4,757,582 A * 7/1988 Verkasalo ..... 100/332
4,948,466 A 8/1990 Jaakkola ..... 162/207
5,392,701 A * 2/1995 Schiel ..... 100/332
5,743,177 A * 4/1998 Wostbrock ..... 100/332

* cited by examiner

*Primary Examiner*—Peter Chin
(74) *Attorney, Agent, or Firm*—Taylor & Aust, P.C.

(57) ABSTRACT

A calender press for use in a paper-making machine includes a top roll positioned adjacent to a nip and rotatable about a longitudinal axis thereof. The top roll has a length and circumferential perimeter. The length extends in the direction of and is longer than the width of the fiber web. The top roll is thermally compensated in a plurality of thermal zones which are adjacent to each other across the length of the top roll, whereby the perimeter of the top roll may be adjusted in a locally adjustable manner toward and away from the nip. A bottom roll is positioned adjacent to the top roll and defines the nip with the top roll. The bottom roll is rotatable about a longitudinal axis thereof and has a length and circumferential perimeter. The length extends in the direction of and is longer than the width of the fiber web. The perimeter is smaller at each longitudinal end of the bottom roll and larger at approximately a midpoint between the longitudinal ends, thereby defining a crowned bottom roll. The bottom roll is thermally compensated in a plurality of thermal zones which are adjacent to each other across the length of the bottom roll, whereby the perimeter of the bottom roll may be adjusted in a locally adjustable manner toward and away from the nip. The thermal compensation of the bottom roll and the top roll coact to effect a nip load of less than approximately 150 pounds per linear inch between the top roll and bottom roll.

18 Claims, 2 Drawing Sheets

CALENDER PRESS FOR A PAPER-MAKING MACHINE WITH THERMALLY COMPENSATED TOP AND BOTTOM ROLLS AND LOW NIP LOAD

This is a continuation of application Ser. No. 09/044,420 filed Mar. 19, 1998.

BACKGROUND OF THE INVENTION

1. Field of the Invention.

The present invention relates to a calender press for use in a paper-making machine, and, more particularly, to a calender press providing locally adjustable nip loading between a top roll and a bottom roll.

2. Description of the Related Art

A paper-making machine includes a wet end, a forming section, a press section, a dryer section, a calender stack, a reel and winder. The calender stack typically is in the form of a plurality of rolls which are stacked in substantially vertical alignment relative to each other. The paper web passes through at least one nip formed by adjacent rolls in the calender stack and is provided with a desired surface finish by the calendering operation.

For a wide paper machine (i.e., a paper machine forming a paper web with a width between approximately 200 to 480 inches), the rolls of a calender stack are typically formed of metal and have a wall thickness of between approximately 3 to 4 inches. The thick walls inhibit sagging of the long roll. It is known to locally adjust the nip load between adjacent rolls by providing pistons within one of the rolls which exert a radially outward force on the inside diameter of the roll, thereby locally deflecting the roll to provide local adjustment of the nip load. Such a piston arrangement works well to locally adjust the nip load on paper grades where a high nip load is required or acceptable (e.g., at least 700 lbs. per linear inch (pli)). However, at lesser nip loads it has been found that the force exerted by the pistons is insufficient to locally deflect the thick wall of a long calender roll. Thus, it is not possible with conventional designs to provide for local adjustment of the nip load on calender rolls having thick walls at low nip loads.

With light weight papers, such as tissue, etc., nip loads of greater than approximately 700 pli in a calender stack may cause "blackening" or dark spots to be formed on the paper web. Since light weight paper grades cannot be calendered at greater than 700 pli, and since local adjustment of the nip load is not possible with conventional calender stacks at less than approximately 700 pli, it is apparent that conventional calender stacks do not allow for local adjustment of the nip load when calendering light weight paper grades.

It is also known to apply heat to rolls in a calender press to adjust for temperature fluctuations in the roll resulting from local or generalized cooling of the roll because of contact with the paper web.

What is needed in the art is a calender which allows local adjustment of the nip load in a calender press on machines forming light weight paper with a wide paper web.

SUMMARY OF THE INVENTION

The present invention provides a calender press with a top roll and a bottom roll which are each crowned and thermally compensated in a zone-wise manner across the length thereof to provide locally adjustable nip loading at relatively low nip loads.

The invention comprises, in one form thereof, a calender press for use in a paper-making machine. The calender press includes a top roll positioned adjacent to a nip and rotatable about a longitudinal axis thereof. The top roll has a length and circumferential perimeter. The length extends in the direction of and is longer than the width of the fiber web. The top roll is thermally compensated in a plurality of thermal zones which are adjacent to each other across the length of the top roll, whereby the perimeter of the top roll may be adjusted in a locally adjustable manner toward and away from the nip. A bottom roll is positioned adjacent to the top roll and defines the nip with the top roll. The bottom roll is rotatable about a longitudinal axis thereof and has a length and circumferential perimeter. The length extends in the direction of and is longer than the width of the fiber web. The perimeter is smaller at each longitudinal end of the bottom roll and larger at approximately a midpoint between the longitudinal ends, thereby defining a crowned bottom roll. The bottom roll is thermally compensated in a plurality of thermal zones which are adjacent to each other across the length of the bottom roll, whereby the perimeter of the bottom roll may be adjusted in a locally adjustable manner toward and away from the nip. The thermal compensation of the bottom roll and the top roll coact to effect a nip load of less than approximately 150 pounds per linear inch between the top roll and the bottom roll.

An advantage of the present invention is that locally adjustable nip loads can be provided between the top roll and the bottom roll at relatively low nip loads.

Another advantage is that the locally adjustable nip loads are provided through thermal rather than mechanical deformations of the top and bottom rolls.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
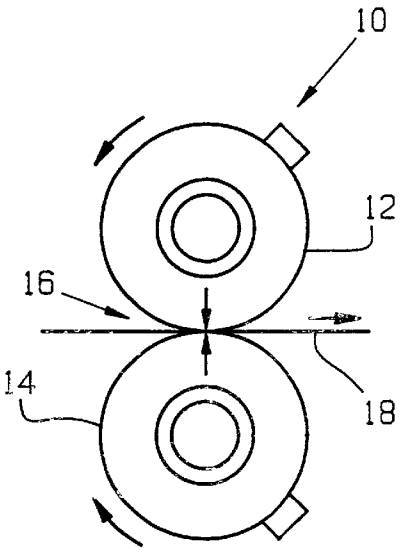
FIG. 2 is an end view of the calender stack of FIG. 1.
Figure 1:
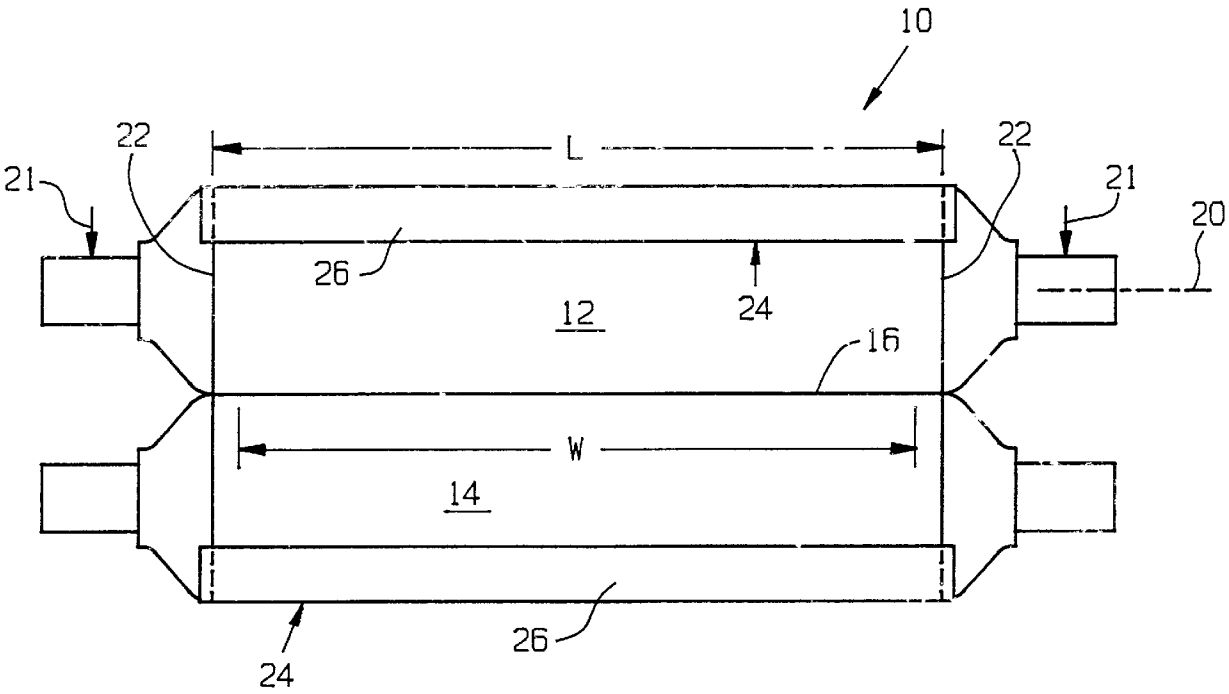
FIG. 1 is a plan view of an embodiment of a calender stack of the present invention, including thermally compensated top and bottom rolls.
Figure 3:
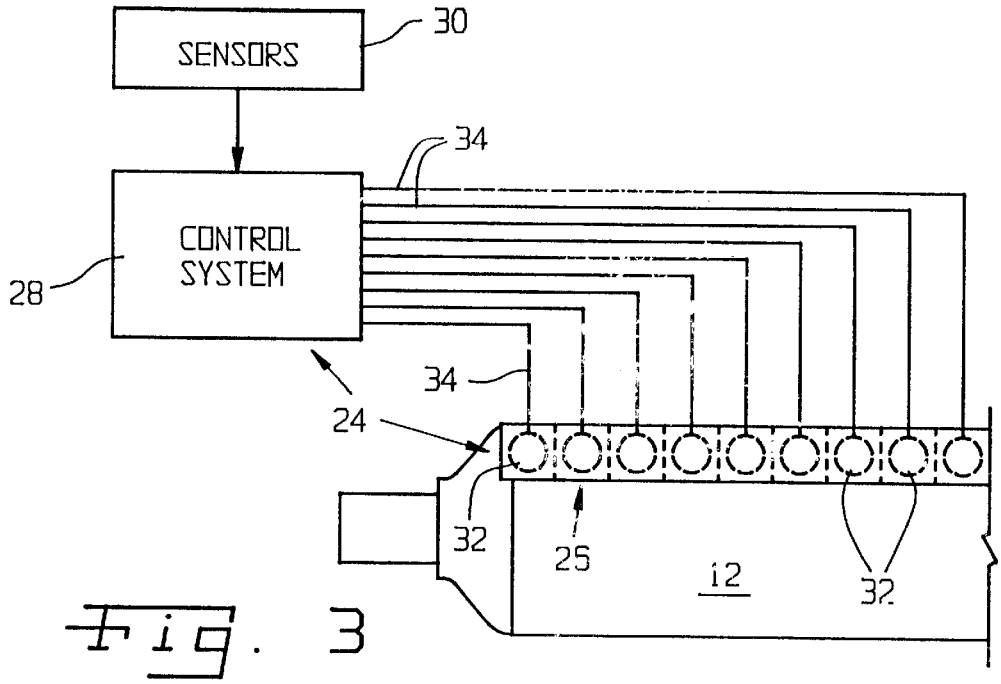
FIG. 3 is an enlarged, fragmentary view of the thermally compensated top roll of FIGS. 1 and 2, with the thermal compensating device being in the form of an electric heating system.

Referring now to the drawings, and particularly to FIGS. 1–3, there is shown a portion of a paper-making machine, including a calender press 10 at the dry end of the machine. Calender press 10 has a plurality of rolls arranged in a vertical stack, including a top roll 12 and a bottom roll 14 defining a press nip 16 therebetween for finishing a surface of a fiber web, such as paper web 18. Calender press 10, to be described in more detail hereinafter, is used to finish the surface of a paper web 18 having a width of at least 200 inches. For example, paper web 18 may have a width between 200 to 480 inches.

Top roll 12 and the associated thermal compensating device 24 are substantially identical to bottom roll 14 and the associated thermal compensating device 24. Accordingly, only top roll 12 and the associated thermal compensating device 24 will be described in detail herein. It is to be understood that bottom roll 14 and the associated thermal compensating device 24 are substantially identical in the embodiment shown in FIGS. 1 and 2.

Top roll 12 is rotatable about a longitudinal axis 20 thereof Top roll 12 has a length L which extends in the direction of and is longer than a width W of fiber web 18. Top roll 12 also has a circumferential perimeter which is smaller at each longitudinal end 22 of top roll 12 and larger at approximately a mid-point between longitudinal ends 22. Top roll 12 thus has a crowned circumferential perimeter which tends to prevent sagging over the length L thereof For example, top roll 12 may have a crown of between 0 to ⅛ inch at the mid-point between longitudinal ends 22. A preload at press nip 16 can be provided by applying a preload at each longitudinal end of top roll 12, as indicated by arrows 21. The preload at the ends of top roll 21 can be accomplished using, e.g., a pneumatic, hydraulic or mechanical loading device.

In the embodiment shown, top roll 12 has a length L which is slightly larger than width W of paper web 18, and has a metal wall thickness of between approximately 3 to 4 inches. Configured as such, top roll 12 has a weight which can easily exceed 20 tons or more. The 3 to 4 inch wall thickness of top roll 12 does not allow local adjustment of the nip load in nip 16 at lower values (e.g., less than approximately 150 pli).

A thermal compensating device 24 thermally compensates top roll 12 in a plurality of thermal zones which are adjacent to each other across length L of top roll 12. The thermal compensation of top roll 12 allows the circumferential perimeter of top roll 12 to be adjusted in a locally adjustable manner toward and away from press nip 16. More particularly, referring to FIG. 3, thermal compensating device 24 is shown in greater detail. Thermal compensating device 24 includes a thermal transfer box 26, a control system 28 and a plurality of sensors 30.

Thermal transfer box 26 includes a plurality of electric heaters 32 which are disposed adjacent to each other across length L of top roll 12. Each electric heater 32 defines a thermal zone in a corresponding area adjacent to top roll 12. By controlling the duration of time and/or amount of electrical power which is applied to each electric heater 32, the amount of heat which is transferred to top roll 12 in the corresponding thermal zone may be varied. More particularly, each electric heater 32 is connected via a corresponding electrical conductor 34 with a control system 28. Control system 28 is connected with a source of electrical power (not shown) for sourcing electrical power to a selected electric heater 32. Sensors 30 provide input data to control system 28 which allows control system 28 to determine which and/or how many electric heaters 32 are to be energized to effect a corresponding local adjustment of the circumferential perimeter of top roll 12. For example, sensor (s) 30 can be in the form of a caliper scanner for measuring the (local) thickness of paper web 18. The thermal energy supplied by each electric heater 32 may effect a maximum local adjustment of the diameter of top roll 12 by not greater than approximately 0.010 inch, and preferably between 0.001 to 0.005 inch. It should be noted, however, that the amount of electrical power supplied to a selected electric heater 32 by control system 28 may be accurately controlled to effect a resultant change in the diameter of top roll 12 with an accuracy of approximately 0.0001 inch.

Thermal compensating device 24 is structured and arranged to locally adjust by varying the circumferential perimeter (and corresponding diameter) of top roll 12, which in turn adjusts the nip load between top roll 12 and bottom roll 14 at low nip load levels. For example, thermally compensating each of top roll 12 and bottom roll 14 allows a nip load of between 0 to 150 pli to be accurately controlled between top roll 12 and bottom roll 14.

Thermal compensating device 24 is in the form of an electric heating system in the embodiment shown in FIG. 3 and described above. However, thermal compensating device 24 may also be in the form of a fluid heating system, fluid cooling system, infrared heating system and induction heating system. It will be appreciated that each of these types of systems may be configured to transfer heat to or from top roll 12, and thereby locally adjust the circumferential perimeter and diameter of top roll 12.

Figure 4:
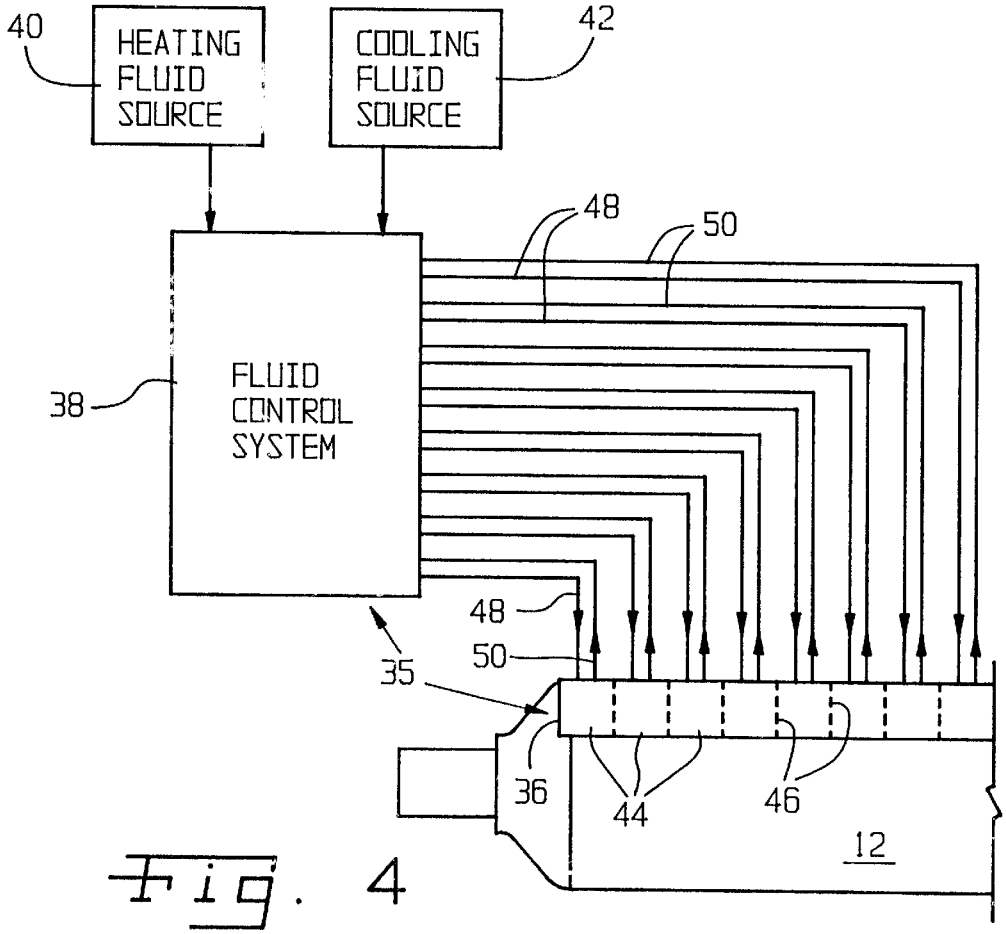
FIG. 4 is an enlarged, fragmentary view of another embodiment of a thermally compensated top roll, with a thermal compensating device in the form of a fluid heating and cooling system.

FIG. 4 illustrates another embodiment of a thermal compensating device 35 which is configured in the form of a fluid heating system and fluid cooling system. Thermal compensating device 35 includes a thermal transfer box 36, fluid control system 38, heating fluid source 40 and cooling fluid source 42. A plurality of sensors (not shown) may also be connected with fluid control system 38 for providing feedback signals indicative of the load in nip 16.

Thermal transfer box 36 is divided into a plurality of fluid chambers 44 which are adjacent to each other across the length L of top roll 12, and separated from one another by intermediate walls 46. Each fluid chamber 44 is fluidly isolated from an adjacent fluid chamber 44, and is connected via a corresponding supply line 48 and return line 50 with fluid control system 38. Fluid control system 38 can supply either hot fluid from heating fluid source 40 or cold fluid from cooling fluid source 42 through a selected supply line 48 to be circulated through a corresponding fluid chamber 44. The flow rate and/or temperature of the fluid circulated through a selected fluid chamber 44 may be varied by fluid control system 38 to provide a desired change in the circumferential perimeter and diameter of top roll 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper-making machine, a calender press including at least two rolls defining a press nip therebetween for finishing a surface of a fiber web, the fiber web having a width of at least 200 inches, said calender press comprising:

a top roll positioned adjacent to the nip and being rotatable about a longitudinal axis thereof, said top roll having a length and circumferential perimeter, said length extending in the direction of and being longer than the width of the fiber web;

a first thermal compensation device structured and arranged for thermally compensating said top roll in a plurality of thermal zones which are adjacent to each other across said length of said top roll, whereby said circumferential perimeter of said top roll may be adjusted in a locally adjustable manner toward and away from the nip;

a bottom roll positioned adjacent to said top roll and defining the nip with said top roll, said bottom roll being rotatable about a longitudinal axis thereof and having a length and circumferential perimeter, said length extending in the direction of and being longer than the width of the fiber web, said perimeter being smaller at each longitudinal end of said bottom roll and larger at approximately a midpoint between said longitudinal ends, thereby defining a crowned bottom roll; and a second thermal compensation device structured and arranged for thermally compensating said bottom roll in a plurality of thermal zones which are adjacent to each other across said length of said bottom roll, said circumferential perimeter of said bottom roll being locally adjustable toward and away from the nip, said second thermal compensation device and said first thermal compensation device being structured and arranged for co-acting to effect a nip load of less than approximately 150 pounds per linear inch between said top roll and said bottom roll.

2. The calender press of claim 1, wherein said first thermal compensation device in a locally adjustable manner comprises one of an electric heating system, fluid heating system, fluid cooling system, infrared heating system and induction heating system.

3. The calender press of claim 2, wherein said first thermal compensation device in a locally adjustable manner comprises an electric heating system including a plurality of electric heaters which are adjacent to each other across said length of said top roll.

4. The calender press of claim 1, wherein first thermal compensation device in a locally adjustable manner comprises at least one of a fluid heating system and fluid cooling system.

5. The calender press of claim 4, wherein said first thermal compensation device in a locally adjustable manner includes a plurality of fluid chambers which are adjacent to each other across said length of said top roll, and wherein said at least one of a fluid heating system and fluid cooling system respectively independently circulate at least one heating fluid and at least one cooling fluid through said plurality of fluid chambers.

6. The calender press of claim 1, wherein said second thermal compensation device in a locally adjustable manner comprises one of an electric heating system, fluid heating system, fluid cooling system, infrared heating system and induction heating system.

7. The calender press of claim 6, wherein said second thermal compensation device in a locally adjustable manner comprises an electric heating system including a plurality of electric heaters which are adjacent to each other across said length of said bottom roll.

8. The calender press of claim 1, wherein said second thermal compensation device in a locally adjustable manner comprises at least one of a fluid heating system and fluid cooling system.

9. The calender press of claim 8, wherein said second thermal compensation device in a locally adjustable manner includes a plurality of fluid chambers which are adjacent to each other across said length of said bottom roll, and wherein said at least one of a fluid heating and fluid cooling system respectively independently circulate at least one heating fluid and at least one cooling fluid through said plurality of fluid chambers.

10. The calender press of claim 1, wherein said perimeter of said top roll is smaller at each longitudinal end of said top roll and larger at approximately a midpoint between said longitudinal ends, thereby defining a crowned top roll.

11. The calender press of claim 10, wherein said crowned top roll and said crowned bottom roll each have a crown of less than approximately one-eighth inch.

12. The calender press of claim 1, wherein each of said second thermal compensation device and said first thermal compensation device are structured and arranged to respectively locally adjust a diameter of said bottom roll and a diameter of said top roll by not greater than approximately 0.010 inch.

13. The calender press of claim 12, wherein each of said second thermal compensation device and said first thermal compensation device are structured and arranged to respectively locally adjust a diameter of said bottom roll and a diameter of said top roll by not greater than approximately 0.005 inch.

14. The calendar press of claim 1, wherein said top roll and said bottom roll each have a wall thickness of between approximately three and four inches.

15. In a paper-making machine, a method for adjusting a nip load in a calendar press between two adjacent rolls, comprising the steps of:

providing a top roll and a bottom roll adjacent one another and defining a nip load of not more than approximately 150 pounds per linear inch therebetween, the top roll and the bottom roll having a circumferential perimeter and a length; and selectively adjusting the circumferential perimeter along said length of each of said top and bottom rolls through selective application of energy to or withdrawal of energy from said each of said top roll and said bottom roll to thereby maintain the nip load therebetween at no more than approximately 150 pounds per linear inch.

16. The method of claim 15, wherein the energy is thermal energy.

17. The method of claim 15, wherein the circumferential perimeter of both the top and bottom roll are adjusted.

18. The method of claim 15, further comprising the step of feeding a lightweight grade paper between the top roll and the bottom roll.

* * * * *